US011198927B1

(12) United States Patent
Chaput et al.

(10) Patent No.: US 11,198,927 B1
(45) **Date of Patent: *Dec. 14, 2021**

(54) NIOBIUM ALLOYS FOR HIGH TEMPERATURE, STRUCTURAL APPLICATIONS

(71) Applicant: Government of the United States, as represented by the Secretary of the Air Force, Wright-Patterson AFB, OH (US)

(72) Inventors: Kevin J. Chaput, Beavercreek, OH (US); Oleg M. Senkov, Fairborn, OH (US); Todd M. Butler, Beavercreek, OH (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 27 days.

This patent is subject to a terminal disclaimer.

(21) Appl. No.: 16/583,549

(22) Filed: Sep. 26, 2019

(51) Int. Cl.
*C22C 27/02* (2006.01)

(52) U.S. Cl.
CPC ..... *C22C 27/02* (2013.01)

(58) Field of Classification Search
CPC ..... C22C 27/02
See application file for complete search history.

(56) References Cited

U.S. PATENT DOCUMENTS 2,822,268 A * 2/1958 Hix ..... C22C 27/02 420/426
2,838,395 A 6/1958 Rhodin
2,881,069 A 4/1959 Rhodin
2,882,146 A * 4/1959 Rhodin, Jr. ..... C22C 27/02 420/426
2,985,531 A 5/1961 Gordon et al.
3,001,870 A 9/1961 McCullough et al.
3,022,163 A * 2/1962 Lottridge, Jr. ..... C22C 27/02 420/426

(Continued)

FOREIGN PATENT DOCUMENTS

CA 2682455 A1 * 4/2011 ..... F01D 5/288
CN 106756374 A * 5/2017

(Continued)

OTHER PUBLICATIONS

He, Effect of Mo on microstructure and mechanical properties of Nb—Ti—C—B multiphase alloy, Nov. 19, 2012, Elsevier, Journal of Alloys and Compounds, vol. 551, p. 578-583 (Year: 2012).*

(Continued)

*Primary Examiner* — Christopher S Kessler
*Assistant Examiner* — Andrew M Cheung
(74) *Attorney, Agent, or Firm* — AFMCLO/JAZ; James F. McBride

(57) ABSTRACT

The present invention relates to Nb-based refractory alloys that are less expensive and less dense than some of the current Nb-based refractory alloys, have similar or better ductility, strength specific yield strength and oxidation resistance when compared to current Nb-based refractory alloys. Such Nb-based refractory alloys typically continue to be compatible with current coating systems for Nb-based refractory alloys. Such Nb-based refractory alloys are disclosed herein.

11 Claims, 6 Drawing Sheets

(56) References Cited

U.S. PATENT DOCUMENTS

| | | | | |
|---|---|---|---|---|
| 3,027,255 | A | 3/1962 | Begley et al. | |
| 3,043,683 | A | 7/1962 | Hix | |
| 3,046,109 | A * | 7/1962 | Lottridge, Jr. | C22C 27/02 420/426 |
| 3,086,859 | A * | 4/1963 | Jefferys | C22C 27/02 420/426 |
| 3,125,445 | A * | 3/1964 | Lottridge | C22C 27/02 420/426 |
| 3,152,891 | A | 10/1964 | Begley | |
| 3,156,560 | A | 11/1964 | Semmel | |
| 3,206,305 | A | 9/1965 | Begley et al. | |
| 3,346,379 | A | 10/1967 | Rohin | |
| 3,366,513 | A | 1/1968 | Barber et al. | |
| 3,395,012 | A | 7/1968 | McAdam et al. | |
| 3,639,180 | A | 2/1972 | Kelcher | |
| 3,682,626 | A | 8/1972 | Begley et al. | |
| 3,830,670 | A * | 8/1974 | Van Thyne | C23C 8/34 148/316 |
| 4,299,625 | A | 11/1981 | Michel et al. | |
| 4,836,849 | A | 6/1989 | Svedberg et al. | |
| 4,931,254 | A | 6/1990 | Jackson | |
| 4,983,358 | A | 1/1991 | Hebsur et al. | |
| 5,000,913 | A | 3/1991 | Jackson | |
| 5,006,307 | A | 4/1991 | Jackson | |
| 5,284,618 | A * | 2/1994 | Allouard | C22C 27/02 420/417 |
| 5,366,565 | A | 11/1994 | Jackson | |
| 6,238,491 | B1 | 5/2001 | Davidson et al. | |
| 8,512,485 | B2 | 8/2013 | Feng et al. | |
| 9,938,610 | B2 | 4/2018 | Helmink et al. | |
| 10,227,680 | B2 * | 3/2019 | Tsakiropoulos | C22C 27/02 |
| 2002/0185524 | A1 | 12/2002 | Zhao et al. | |
| 2007/0020136 | A1 * | 1/2007 | Menon | C22C 27/02 420/426 |
| 2015/0368754 | A1 | 12/2015 | Aimone et al. | |

FOREIGN PATENT DOCUMENTS

| | | | | |
|---|---|---|---|---|
| EP | 0072893 B1 * | 12/1986 | | C22C 45/02 |
| EP | 288678 A2 | 2/1988 | | |
| EP | 374507 A1 | 6/1990 | | |
| EP | 377810 A1 | 7/1990 | | |
| EP | 532658 B1 | 3/1993 | | |
| EP | 372322 B1 | 10/1993 | | |
| RU | 2625203 C1 | 7/2017 | | |
| WO | WO-9209713 A1 * | 6/1992 | | C22C 30/00 |

OTHER PUBLICATIONS

Mayo, G. T. J.; Shepherd, W. H.; Thomas, A.G.; Oxidation Behaviour of Niobium-Chromium Alloys, Journal of the Less-Common Metals, 1960, 2, 223-232.

Ebbinghaus, B.B.; Thermodynamics of Gas Phase Chromium Species: The Chromium Oxides, the Chromium Dxyhydroxides, and Volatility Calculations in Waste Incineration Processes; Combustion and Flame 1993, 93:119-137.

Stanislowski, M.; Wessel, E.; Hilpert, K.; Markus, T.; Singheiser, L.; Chromium Vaporization from High-Temperature Alloys I. Chromia-Forming Steels and the Influence of Outer Oxide Layers, Journal of The Electrochemical Society, 2007, 154 (4) A295-A306.

Philips, N.R.et al.; New opportunities in refractory alloys, Metall. Mater. Trans. 2020, 51, 3299-3310.

Couzinie, J.P.; et al. Comprehensive data compilation on the mechanical properties of refractory high-entropy alloys, Data in Brief, 2018, 21, pp. 1622-1641.

Brady, M.P. et al.; "Alloy design strategies for promoting protective oxide-scale formation," 2000, JOM 52, 16-21.

Giggins, C.S. et al.; "Oxidation of Ni—Cr—Al Alloys Between 1000° C. and 1200° C.", J. Electrochem. Soc. 1971, 118, 1782-1790.

Jul. 26, 2021 Non-Final Office Action For USPA U.S. Appl. No. 16/916,198.

Backman, L.; Opila E. J.; Thermodynamic assessment of the group IV, V and VI oxides for the design of oxidation resistant multi-principal component materials, Journal of the European Ceramic Society, 2019, 39, 1796-1802.

* cited by examiner

NIOBIUM ALLOYS FOR HIGH TEMPERATURE, STRUCTURAL APPLICATIONS

RIGHTS OF THE GOVERNMENT

The invention described herein may be manufactured and used by or for the Government of the United States for all governmental purposes without the payment of any royalty.

CROSS-REFERENCE TO RELATED APPLICATION

The present application claims priority to U.S. Provisional Application Ser. No. 62/746,988 filed Oct. 17, 2018, the contents of which is hereby incorporated by reference in their entry

FIELD OF THE INVENTION

The present invention relates to Nb-based refractory alloys and processes of making and using same.

BACKGROUND OF THE INVENTION

Nb-based refractory alloys currently used in some high-temperature structural applications contain expensive and dense alloying elements. For example, C-103, which is one of the most commonly used medium-strength Nb alloys, contains (by atomic percent) 5.4 Hf, 0.3 Ta, 0.3 W, 0.7 Zr, 2.0 Ti, and remaining Nb; and a high strength C-3009 contains 19.2 Hf, 5.6 W and remaining Nb. Such metals as Hf, Ta and Zr are expensive, costing approximately $1200, $290 and $150 per kilogram, respectively, and Hf, W and Ta have high density of, respectively, 13.21, 16.65 and 19.25 g/cm$^3$. Moreover, these alloys have poor oxidation resistance above 600° C. and thus require oxidation resistive coatings. There has been extensive efforts put forth to solve the above mention problems including research on Nb alloys containing Si, which main goal is to improve both high temperature strength and oxidation resistance; however, Nb—Si alloys are generally brittle at temperatures ≤1000° C. and they have not found practical use yet. Refractory complex concentrated alloys (RCCAs) or refractory high entropy alloys (RHEAs) are another promising direction of research but such research has yet to result in a Nb-based refractory alloy that is known to solve the aforementioned problems.

In view of the foregoing, Applicants invented Nb-based refractory alloys that are less expensive and less dense than current Nb-based refractory alloys, yet which have similar or better ductility, high temperature strengths and oxidation resistance when compared to current Nb-based refractory alloys. Furthermore, Applicants' Nb-based refractory alloys typically continue to be compatible with current oxidation resistive coating systems that are employed to improve the oxidation resistance of Nb-based refractory alloys. Applicants disclose their improved Nb-based refractory alloys herein.

SUMMARY OF THE INVENTION

The present invention relates to Nb-based refractory alloys that are less expensive and less dense than current Nb-based refractory alloys, yet which have similar or better ductility, high temperature strengths and oxidation resistance when compared to current Nb-based refractory alloys.

Such Nb-based refractory alloys typically continue to be compatible with current coating systems for Nb-based refractory alloys. Such Nb-based refractory alloys are disclosed herein.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF THE INVENTION

Definitions

Figure 1A:
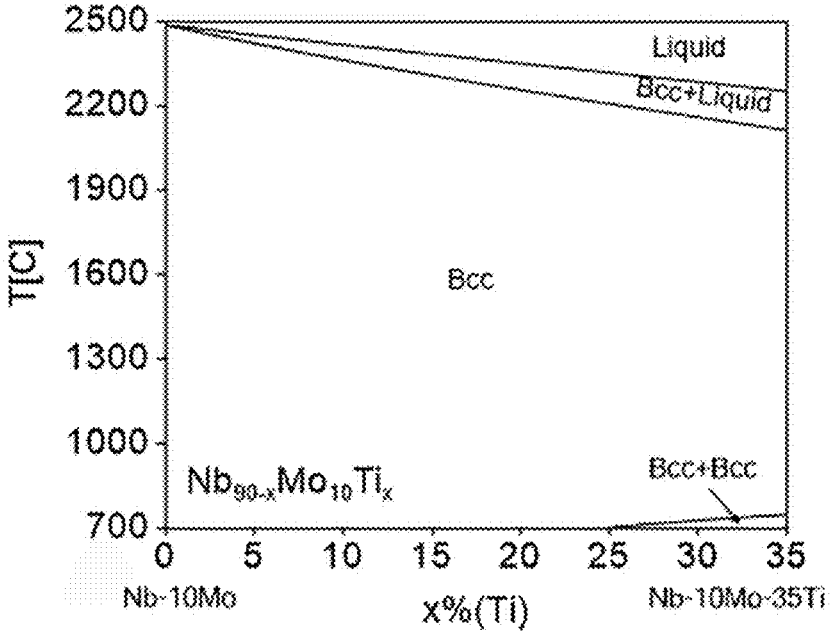
FIG. 1A is an equilibrium phase diagram of $Nb_{90-x}Mo_{10}Ti_x$ alloy system with x ranging from 0 at. % to 35 at. %.

Unless specifically stated otherwise, as used herein, the terms "a", "an" and "the" mean "at least one".

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Detailed Description of the Invention

Nb—Mo—Ti-Based Refractory Alloys

Applicants disclose a Nb—Mo—Ti alloy comprising Nb, about 4 atomic percent to about 35 atomic percent Mo, preferably about 8 atomic percent to about 30 atomic percent Mo, more preferably about 15 atomic percent to about 25 atomic percent Mo, and about 5 atomic percent to about 35 atomic percent Ti, preferably about 10 atomic percent to about 25 atomic percent Ti, more preferably about 15 atomic percent to about 25 atomic percent Ti. For purposes of this specification, headings are not considered paragraphs and thus this paragraph is Paragraph 0027 of the present specification. The individual number of each paragraph above and below this paragraph can be determined by reference to this paragraph's number.

The Nb—Mo—Ti alloy of Paragraph 0027 wherein Nb is the balance of said Nb—Mo—Ti alloy.

The Nb—Mo—Ti alloy of Paragraph 0027, said Nb—Mo—Ti alloy comprising an elemental alloy addition selected from the group consisting of Cr, Fe, W, Zr, C, N, O and mixtures thereof.

The Nb—Mo—Ti alloy of Paragraph 0029 wherein at least one of said elemental alloy additions is present at the following level:

a) from about 0.1 atomic percent to about 15 atomic percent Cr, preferably from about 0.1 atomic percent to about 3.0 atomic percent Cr or from about 5.0 atomic percent to about 15.0 atomic percent Cr, more preferably from about 1.0 atomic percent to about 2.5 atomic percent Cr or from about 7.0 atomic percent to 12.0 atomic percent Cr;

b) from about 0.1 atomic percent to about 5.0 atomic percent Fe preferably from about 0.1 atomic percent to about 3.5 atomic percent Fe, more preferably from about 0.5 atomic percent to about 2.5 atomic percent Fe;

c) from about 0.1 atomic percent to about 20 atomic percent W, preferably from about 2.0 atomic percent to about 17.0 atomic percent W, more preferably from about 5.0 atomic percent to about 10.0 atomic percent W;

d) from about 0.1 atomic percent to about 20 atomic percent Zr, preferably from about 2.0 atomic percent to about 15.0 atomic percent Zr, more preferably from about 5.0 atomic percent to about 10.0 atomic percent Zr;

e) from about 0.001 atomic percent to about 1.0 atomic percent C, preferably from about 0.001 atomic percent to about 0.1 atomic percent C, more preferably from about 0.001 atomic percent to about 0.03 atomic percent C;

f) from about 0.001 atomic percent to about 1.0 atomic percent N, preferably from about 0.001 atomic percent to about 0.1 atomic percent N, more preferably from about 0.001 atomic percent to about 0.03 atomic percent N;

g) from about 0.001 atomic percent to about 1.0 atomic percent O, preferably from about 0.001 atomic percent to about 0.1 atomic percent O, more preferably from about 0.001 atomic percent to about 0.03 atomic percent O.

The Nb—Mo—Ti alloy of Paragraph 0029 comprising two, three, four, five, six or seven of said elemental alloy additions.

The Nb—Mo—Ti alloy of Paragraphs 0030 through 0031, said Nb—Mo—Ti alloy comprising a total of no more than about 20 atomic percent of combined Cr, Fe, W, Zr elemental alloy additions. Exceeding 20 atomic percent of these elements in some embodiments may cause brittleness.

The Nb—Mo—Ti alloy of Paragraphs 0027 through 0032 in which elemental impurities are present in a total amount not exceeding about 2 atomic percent, preferably a total amount not exceeding about 1 atomic percent, more preferably a total amount not exceeding about 0.5 atomic percent.

The Nb—Mo—Ti alloy of Paragraph 0033 in which said elemental impurities are any elements not recited by Paragraphs 0027 through 0030.

An article comprising a Nb—Mo—Ti alloy according to any of Paragraphs 0027 through 0034, said article being selected from the group consisting of aircraft, spacecraft, munition, ship, vehicle, thermal protection system, and power generation system; preferably said article comprises a nuclear reactor, engine, an airframe that comprises said Nb—Mo—Ti alloy.

Figure 1B:
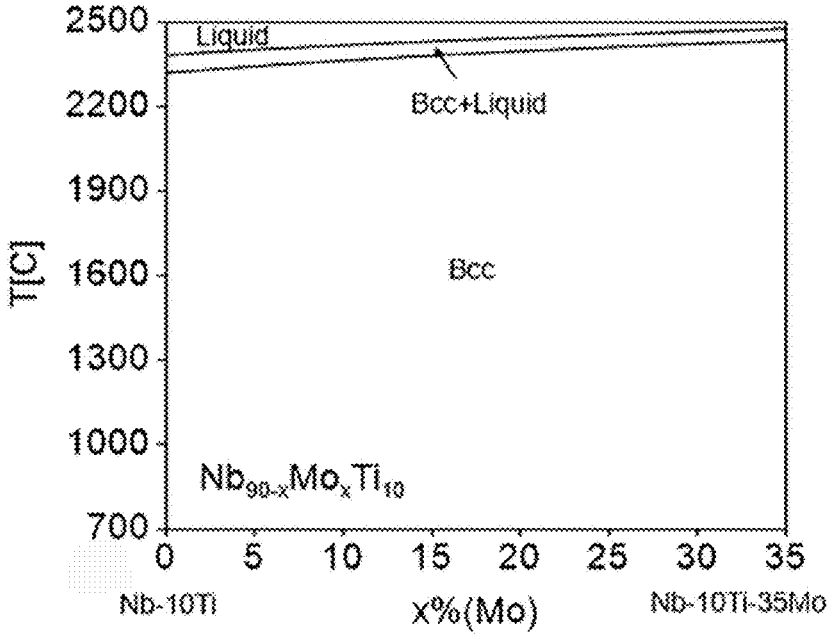
FIG. 1B is an equilibrium phase diagram of $Nb_{90-x}Ti_{10}Mo_x$ alloy system with x ranging from 0 at. % to 35 at. %.
Figure 1C:
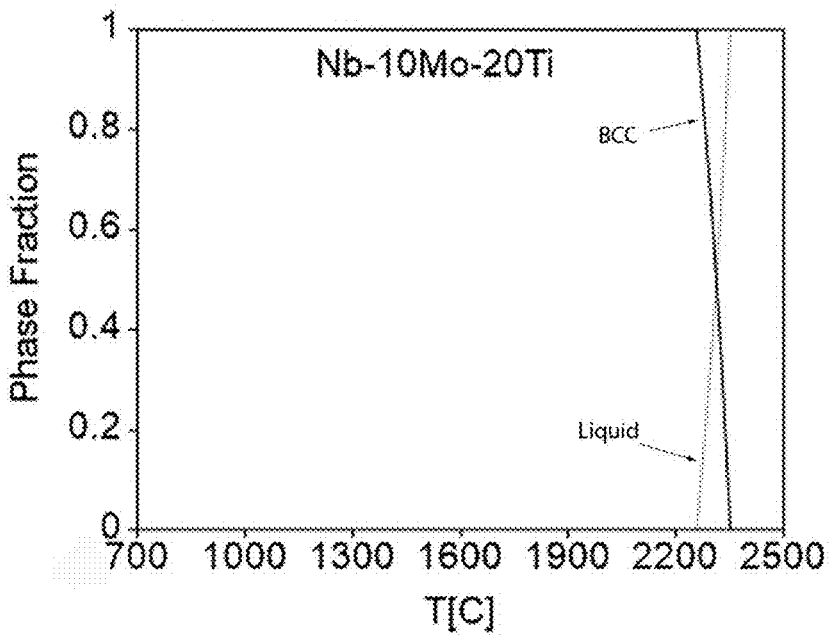
FIG. 1C is an equilibrium phase diagram of $Nb_{70}Mo_{10}Ti_{20}$ alloy. Subscripts indicate atomic percent of the respective element.
Figure 1D:
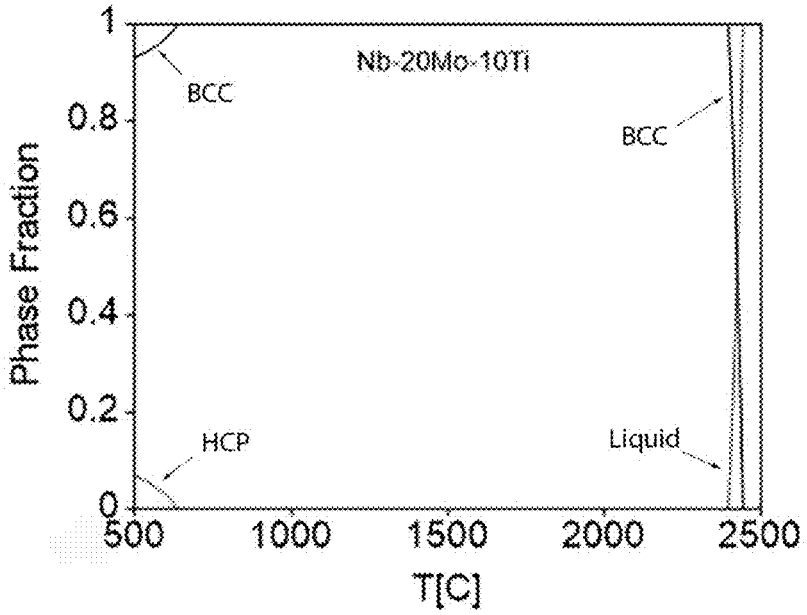
FIG. 1D is an equilibrium phase diagram of $Nb_{70}Mo_{20}Ti_{10}$ alloy. Subscripts indicate atomic percent of the respective element.

The Nb—Mo—Ti alloys containing 30 at. % to 91 at. % Nb, 4 at. % to 35 at. % Mo, 5 at. % to 35 at. % Ti are single-phase body center cubic (BCC) structures over a wide temperature range. FIG. 1A shows, as an example, equilibrium phase diagram for $Nb_{90-x}Mo_{10}Ti_x$ alloy system, where x varies from 0 at. % to 35 at. %. The Nb alloys with 10 at. % Mo are single-phase BCC structures at the concentrations of Ti from 0 at. % to 25 at. %. The Nb alloys with 10 at. % Mo and the amount of Ti between 25 at. % and 35 at. % have two BCC phases below 750° C. FIG. 1B shows, as an example, equilibrium phase diagram for $Nb_{90-x}Mo_xTi_{10}$ alloy system, where x varies from 0 to 35 atomic percent. The alloys of this alloy system are single-phase BCC structures and melting temperatures between 2250° C. and 2450° C. FIG. 1C shows the phase diagram of Nb-10 at. % Mo-20 at. % Ti alloy and FIG. 1C shows the phase diagram of Nb-20 at. % Mo-10 at. % Ti alloy. Only a single BCC phase is present in these alloys below the melting point. The absence of the phase transformations below the melting temperature makes these compositions attractive for high-temperature use.

Figure 2A:
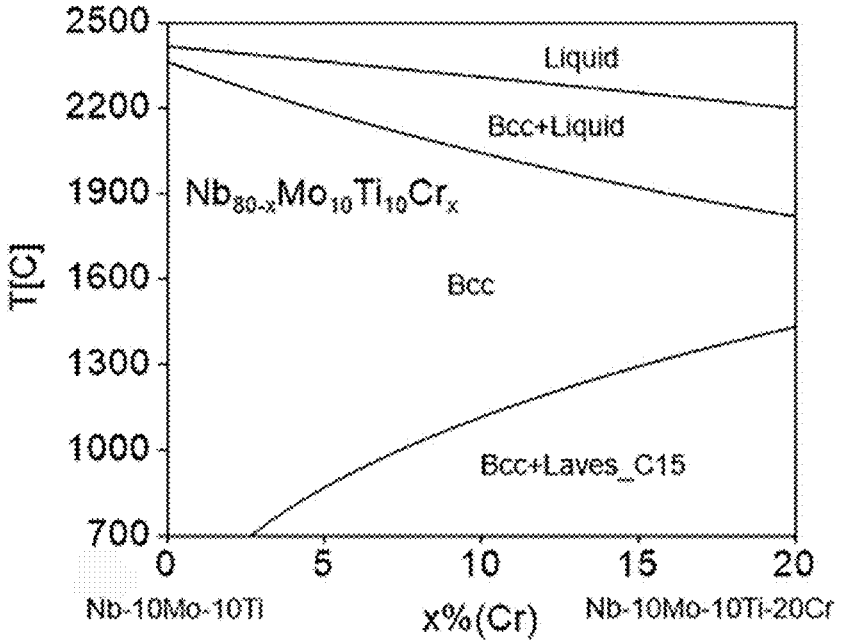
FIG. 2A is an equilibrium phase diagram of an $Nb_{80-x}Mo_{10}Ti_{10}Cr_x$ alloy system with x ranging from 0 at. % to 20 at. %.
Figure 2B:
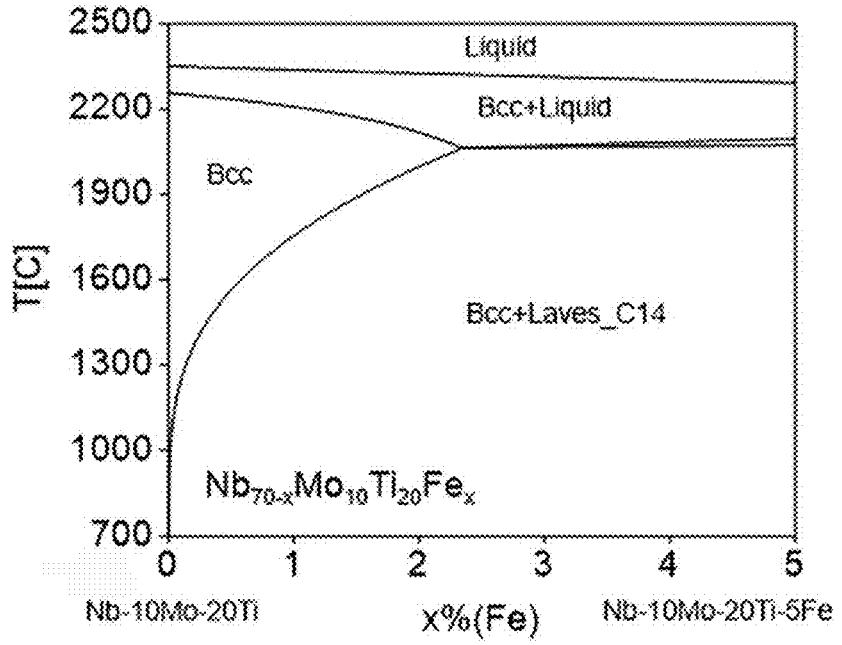
FIG. 2B is an equilibrium phase diagram of an $Nb_{70-x}Mo_{10}Ti_{20}Fe_x$ alloy system with x ranging from 0 at. % to 5 at. %.

FIGS. 2A and 2B are, respectively, equilibrium phase diagrams of $Nb_{80-x}Mo_{10}Ti_{10}Cr_x$ and $Nb_{70-x}Mo_{10}Ti_{20}Fe_x$ alloy systems. FIG. 2A shows that addition of Cr results in the formation of a secondary, cubic Laves (C15) phase, which solvus temperature increases from 700° C. to 1450° C. with increasing Cr from 3 at. % to 20 at. %. FIG. 2B shows that addition of Fe results in the formation of a secondary, hexagonal Laves (C14) phase, which solvus temperature increases from 900° C. to 2000° C. with increasing Fe from 0 at. % to 2.5 at. %. At the concentrations of Fe between 2.5 at. % and 5 at. %, two phases, BCC and Laves, are present up to the melting temperature. The presence of a single-phase BCC region at high temperatures and two-phase, BCC+Laves, region below the Laves solvus line makes the Nb—Mo—Ti—Cr and Nb—Mo—Ti—Fe alloys heat treatable, which allows controlling mechanical properties.

Figure 3A:
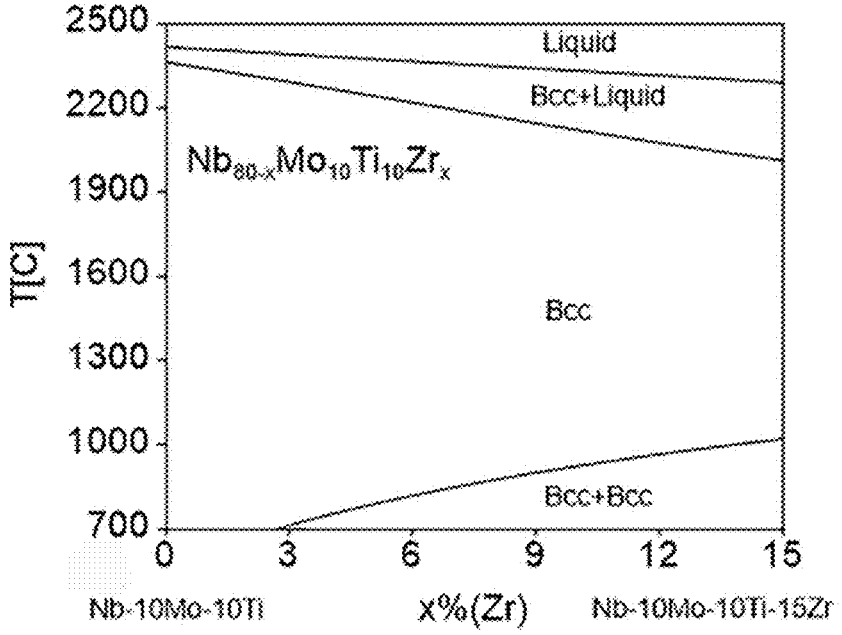
FIG. 3A is an equilibrium phase diagram of an $Nb_{80-x}Mo_{10}Ti_{10}Zr_x$ alloy system with x ranging from 0 at. % to 15 at. %.
Figure 3B:
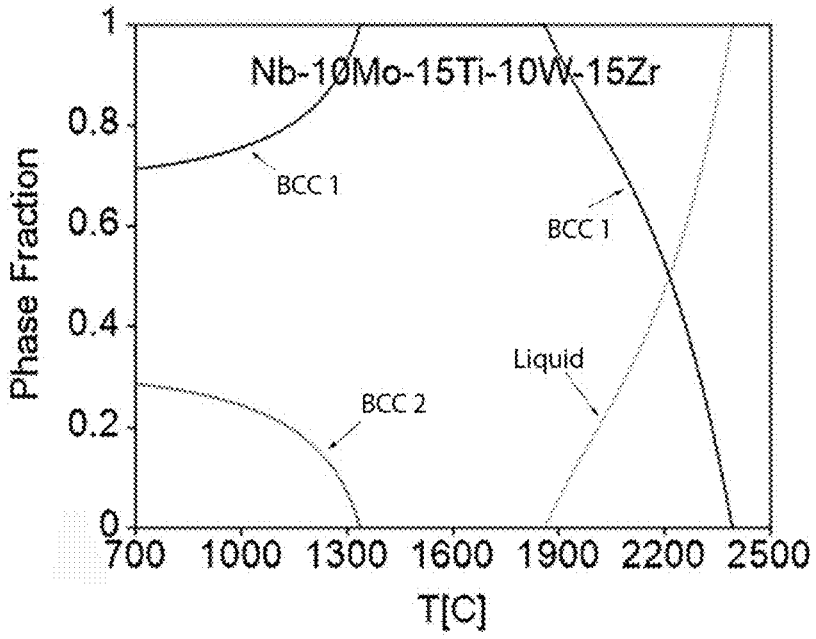
FIG. 3B is an equilibrium phase diagram of an $Nb_{50}Mo_{10}Ti_{15}W_{10}Zr_{15}$ alloy.

FIGS. 3A and 3B respectively illustrate equilibrium phase diagrams of $Nb_{80-x}Mo_{10}Ti_{10}Zr_x$ alloy system and a $Nb_{50}Mo_{10}Ti_{15}W_{10}Zr_{15}$ alloy. The phase diagrams show that the alloying of Nb—Mo—Ti alloys with Zr, W or Zr and W results in the formation of secondary BCC phase, which can make the alloys heat treatable and allows additional precipitation strengthening.

Figure 4A:
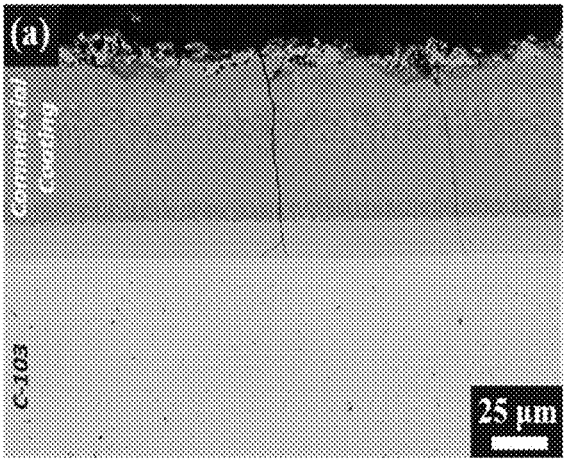
FIG. 4A is a cross-section backscattered electron image of as-deposited commercial R512E slurry coating on commercial C103 alloy.
Figure 4B:
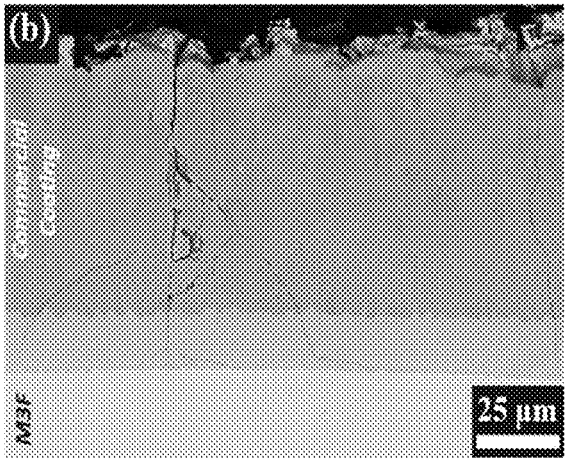
FIG. 4B is a cross-section backscattered electron image of as-deposited commercial R512E slurry coating on Nb-15Mo-20Ti-3Fe alloy (M3F).
Figure 4C:
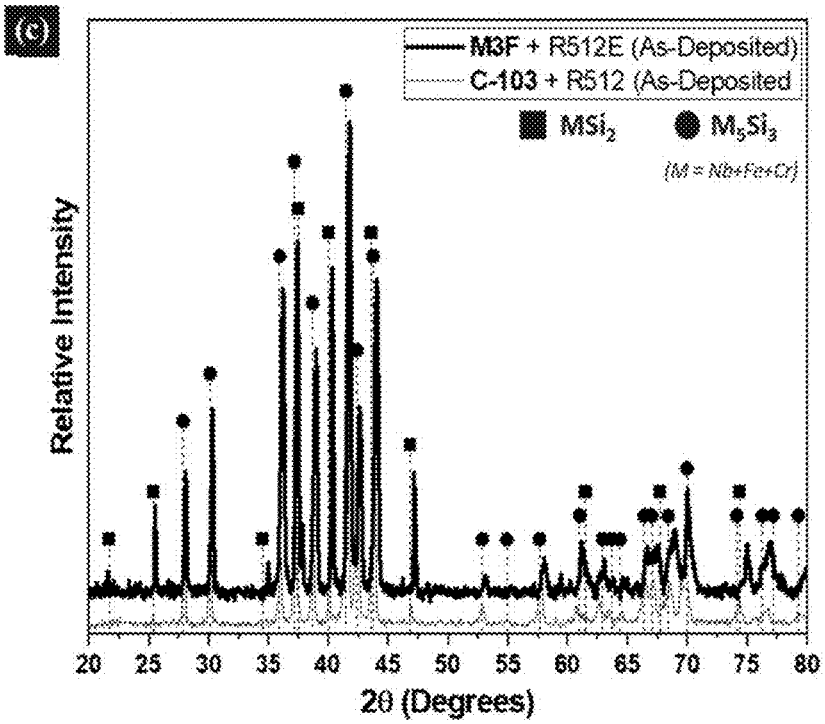
FIG. 4C is X-ray diffraction spectra, captured in plan-view, from as-deposited commercial R512E slurry coating on commercial C103 alloy (thin line) and Nb-15Mo-20Ti-3Fe alloy (thick line). Peaks relating to mixed silicide phases containing Nb, Fe, and Cr are shown for reference.

FIGS. 4A and 4B illustrate, as an example, the commercial slurry coating integration and compatibility of Nb-15Mo-20Ti-3Fe alloy (M3F), as compared with commercial C103 alloy. In particular, FIGS. 4A and 4B show cross-section microstructures of commercially deposited R512E slurry coating on commercial C103 and Nb-15Mo-20Ti-3Fe alloy (M3F), respectively. The Nb-15Mo-20Ti-3Fe alloy exhibits similar integration of the coating as compared to commercial C103. In addition, FIG. 5C shows X-ray diffraction measurements of the as-deposited coatings on the Nb-15Mo-20Ti-3Fe alloy and commercial C103 alloy. It is observed that the Nb-15Mo-20Ti-3Fe alloy forms similar distribution of silicide phases compared to the coated commercial C103 alloy, as is shown by the crystallographic signatures, indicating similar compatibility of these two alloys with commercial R512E slurry coating.

Figure 5:
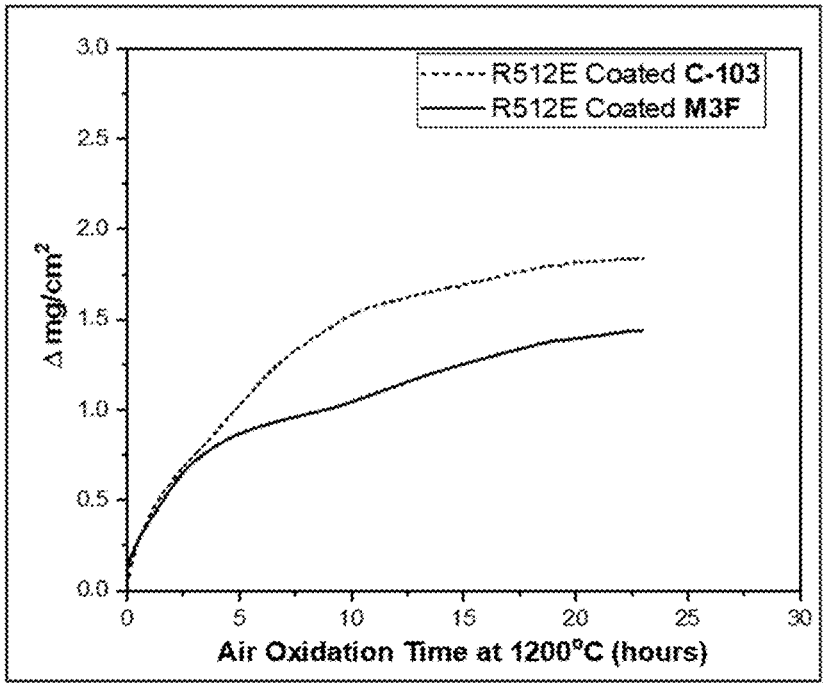
FIG. 5 is a specific mass change (mg/cm$^2$) plot vs time for oxidation in air at 1200° C. of R512E commercial slurry coated Nb-15Mo-20Ti-3Fe alloy and R512E commercial slurry coated C103 alloy It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

FIG. 5 illustrates the oxidation kinetics of the alloys coated with the commercial R512E slurry. Based on this data and testing conditions, the coated Nb-15Mo-20Ti-3Fe alloy (M3F) exhibits slightly lower, yet comparable mass gain up to 24 hours of oxidation in air at 1200° C. compared to coated commercial C103 alloy, indicating no significant loss in oxidation resistance after commercial R512E slurry coating integration on the Nb-15Mo-20Ti-3Fe alloy.

Process of Making Nb—Mo—Ti-Based Refractory Alloys

The alloys can be made using different processing methods, which may include, but are not limited to, mixing, melting, casting, powder metallurgy making and processing, cold and hot working, heat treatment and/or thermo-mechanical treatment. The alloys can be used in the form of cast products, powder metallurgy products including additive manufacturing, worked (rolled, forged, extruded, etc.) products, in the as-produced, annealed or heat treated conditions.

Test Methods

Compression rectangular test specimens with the dimensions of 4.6 mm×4.6 mm×7.6 mm were electric discharge machined (EDM) from larger pieces of alloy material and their surfaces were polished with a 400 grit SiC paper. The specimens were compression deformed along the longest direction at different temperatures and a rams speed of 0.0076 mm/s. The room temperature tests were conducted in air and high temperature tests were conducted in a $10^{-5}$ Torr vacuum.

Oxidation test specimens were electric discharge machined (EDM) from larger pieces of alloy material. Uncoated oxidation samples were sectioned into a rectangular geometries measuring 4.6 mm×4.6 mm×7.4 mm. Samples intended for coating and subsequent oxidation were sectioned into disks with 9.5 mm diameter and 3.2 mm thickness. In all cases, recast layers were removed using coarse grinding paper, followed by standard metallographic techniques up to a 600 grit finish and finally cleaned in isopropanol. Commercial R512E slurry coatings were applied to the "disk" specimens by a commercial vendor using standard techniques developed for coating commercial C103 alloys. All subsequent oxidation tests (coated and uncoated specimens) were conducted using a thermogravimetric analyzer (TGA) using bottled air for reaction gas and ultra-high purity argon for the balance gas. Specimens were heated under inert atmosphere and then subsequently oxidized in air at 1200° C. Only data captured during the oxidation regime (in air) is represented here.

Examples

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

While the alloys of the present invention can be made by a number of methods, to prove the concept, seven Nb alloys, which composition (in at. %) is shown in Table 1 were produced by vacuum arc melting. The density of the produced alloys, which do not contain W, is in the range from 7.70 g/cm$^3$ for alloy M4 to 8.03 g/cm$^3$ for alloys M3 and M3Fe, which is considerably smaller than the density of commercial alloys C103 (8.86 g/cm$^3$) or C-3009 (10.3 g/cm$^3$). The density of MW1 (8.94 g/cm$^3$), which contains W, is higher than that of C103 but smaller that the density of C-3009. Vickers Hardness of all the produced alloys are higher than the Vickers hardness of C1-3 or C-3009 (Table 1).

TABLE 1

Density (ρ), Vickers hardness (HV) and chemical composition (in at. %), of the examples alloys. The properties of commercial alloys C103 and C-3009 are also shown for comparison.

| Alloy | ρ (g/cm$^3$) | HV | Nb | Mo | Ti | Fe | W | Hf |
|---|---|---|---|---|---|---|---|---|
| M1 | 7.96 | 221 ± 5 | 73.0 | 9.2 | 17.8 | — | — | — |
| M2 | 7.99 | 282 ± 6 | 70.0 | 11.9 | 18.1 | — | — | — |
| M3 | 8.03 | 287 ± 5 | 67.8 | 14.1 | 18.1 | — | — | — |
| M4 | 7.70 | 389 ± 6 | 34.7 | 32.8 | 32.5 | — | — | — |
| MW1 | 8.94 | 504 ± 6 | 32.9 | 17.0 | 34.4 | — | 15.7 | — |
| M2Fe | 7.99 | 414 ± 8 | 68.7 | 11.5 | 17.7 | 2.1 | — | — |
| M3Fe | 8.03 | 329 ± 5 | 66.0 | 13.4 | 18.3 | 2.3 | — | — |
| C103 | 8.86 | 230 ± 5 | 92.0 | — | 1.0 | — | 0.5 | 5.4 |
| C-3009 | 10.3 | 274 ± 8 | 71.7 | — | — | — | 5.9 | 22.4 |

In the temperature range of 20° C. to 1200° C. the alloys are ductile and can be forged or rolled. The yield strength values are given in Table 2 and compared with the properties of commercial alloys C-103 and C-3009. All produced alloys are stronger than C-103 in the temperature range from 20° C. to 1200° C. All the produced alloys are stronger than C-3009 at room temperature. The alloys M4, MW1, M2Fe and M3Fe are also stronger than C-3009 at 800° C. and 1000° C., and the alloy MW1 is also stronger than C-3009 at 1200° C.

Table 2. Yield strength (in MPa) of the selected alloys and commercial alloys C-103 and C-3009 at different temperatures.

TABLE 2

Yield strength (in MPa) of the selected alloys and commercial alloys C-103 and C-3009 at different temperatures.

| Alloy | T = 23° C. | T = 800° C. | T = 1000° C. | T = 1200° C. |
|---|---|---|---|---|
| M1 | 521 | 207 | 170 | 97 |
| M2 | 719 | 311 | 250 | 161 |
| M3 | 780 | 329 | 270 | 183 |
| M4 | 1100 | 536 | 504 | 324 |
| MW1 | 1440 | 747 | 635 | 461 |
| M2F | 1080 | 758 | 445 | 188 |
| M3F | 964 | 522 | 456 | 213 |
| C103 | 296 | 169 | 145 | 115 |
| C-3009 | 663 | 424 | 397 | 388 |

The specific yield strength values (yield strength divided by the alloy density) of the selected alloys at different temperatures are shown in Table 3. The specific strength values of commercial alloys C103 and C-3009 are also shown for comparison. All the produced alloys have the specific yield strength values much higher than C103. In the temperature range from room temperature to 1000° C., the specific strengths of alloys M4, MW1, M2Fe and M3Fe are higher than the specific strengths of C-3009. At 1200° C., the specific strength of M4 and MW1 are higher than the specific strengths of C-3009. Table 3. Specific yield strength (in MPa/cm$^3$/g) of the selected alloys and commercial alloys C-103 and C-3009 at different temperatures.

TABLE 3

Specific yield strength (in MPa/cm$^3$/g) of the selected alloys and commercial alloys C-103 and C-3009 at different temperatures.

| Alloy | T = 23° C. | T = 800° C. | T = 1000° C. | T = 1200° C. |
|---|---|---|---|---|
| M1 | 65.5 | 26.0 | 21.4 | 12.2 |
| M2 | 90.0 | 38.9 | 31.3 | 20.2 |
| M3 | 97.1 | 41.0 | 33.6 | 22.8 |
| M4 | 142.9 | 69.6 | 65.5 | 42.1 |
| MW1 | 161.1 | 83.6 | 71.0 | 51.6 |
| M2F | 135.2 | 94.9 | 55.7 | 23.5 |
| M3F | 120 | 65.0 | 56.8 | 26.5 |
| C103 | 33.4 | 19.1 | 16.4 | 13.0 |
| C-3009 | 64.4 | 41.2 | 38.5 | 37.7 |

Commercial R512E slurry coating integration on Nb-15Mo-20Ti-3Fe alloy (M3F), as compared to commercial C103 alloy is shown in FIG. 4A and FIG. 4B. Inspection of each cross-section microstructure in the as-deposited coating condition, as in FIG. 4A and FIG. 4B, demonstrates that the compatibility of R512E on Nb-15Mo-20Ti-3Fe alloy (M3F) is very similar to the behavior on the C103 alloy. This data shows that the integration, adhesion, and mixtures of formed silicides are very similar considering this particular coating on M3F and C103 alloy.

FIG. 5 demonstrates that commercial R512E slurry coated Nb-15Mo-20Ti-3Fe alloy (M3F) exhibits slightly lower, yet comparable oxidation kinetics compared to commercial R512E slurry coated C103 alloy, FIG. 5. This data shows that Nb-15Mo-20Ti-3Fe alloy (M3F) exhibits a similar oxidation performance when coated with commercial R512E slurry coatings, as compared to commercial R512E slurry coated C103 alloy.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A Nb—Mo—Ti alloy comprising: about 21 atomic percent to about 30 atomic percent Mo, about 10 atomic percent to about 25 atomic percent Ti, about 0.1 atomic percent to 1.0 atomic percent Cr, an elemental alloy addition selected from the group consisting of Fe, W, Zr, C, N, O and mixtures thereof, no more than about 2 total atomic percent elemental impurities, and a balance of Nb.

2. A Nb—Mo—Ti alloy according to claim 1 comprising from about 0.001 atomic percent to about 1.0 atomic percent N and/or from about 0.001 atomic percent to about 1.0 atomic percent O.

3. A Nb—Mo—Ti alloy according to claim 1 comprising Nb, about 25 atomic percent to about 30 atomic percent Mo, and about 15 atomic percent to about 25 atomic percent Ti.

4. The Nb—Mo—Ti alloy according to claim 1 wherein at least one of said elemental alloy additions is present at the following level:

a) from about 0.1 atomic percent to about 5.0 atomic percent Fe;
b) from about 0.1 atomic percent to about 20 atomic percent W;
c) from about 0.1 atomic percent to about 20 atomic percent Zr;
d) from about 0.001 atomic percent to about 1.0 atomic percent C;
e) from about 0.001 atomic percent to about 1.0 atomic percent N;
f) from about 0.001 atomic percent to about 1.0 atomic percent O.

5. The Nb—Mo—Ti alloy according to claim 4 wherein at least one of said elemental alloy additions is present at the following level:

a) from about 0.1 atomic percent to about 3.5 atomic percent Fe;
b) from about 2.0 atomic percent to about 17.0 atomic percent W;
c) from about 2.0 atomic percent to about 15.0 atomic percent Zr;
d) from about 0.001 atomic percent to about 0.1 atomic percent C;
e) from about 0.001 atomic percent to about 0.1 atomic percent N;
f) from about 0.001 atomic percent to about 0.1 atomic percent O.

6. The Nb—Mo—Ti alloy according to claim 5 wherein at least one of said elemental alloy additions is present at the following level:
a) from about 0.5 atomic percent to about 2.5 atomic percent Fe;
b) from about 5.0 atomic percent to about 10.0 atomic percent W;
c) from about 5.0 atomic percent to about 10.0 atomic percent Zr;
d) from about 0.001 atomic percent to about 0.03 atomic percent C;
e) from about 0.001 atomic percent to about 0.03 atomic percent N;
f) from about 0.001 atomic percent to about 0.03 atomic percent O.

7. The Nb—Mo—Ti alloy according to claim 4 comprising two, three, four, five or six of said elemental alloy additions.

8. The Nb—Mo—Ti alloy according to claim 4 wherein said Nb—Mo—Ti alloy comprises a total of no more than about 20 atomic percent of combined Cr, Fe, W, Zr elemental alloy additions.

9. The Nb—Mo—Ti alloy according to claim 1 in which elemental impurities are present in a total amount not exceeding about 1 atomic percent.

10. The Nb—Mo—Ti alloy according to claim 9 in which elemental impurities are present in a total amount not exceeding about 0.5 atomic percent.

11. An article comprising a Nb—Mo—Ti alloy according to claim 1, said article being selected from the group consisting of aircraft, spacecraft, munition, ship, and vehicle.

* * * * *